US010178930B2

(12) United States Patent
Samtani

(10) Patent No.: US 10,178,930 B2
(45) Date of Patent: Jan. 15, 2019

(54) MANEUVERABLE CORDLESS STICK VACUUM

(71) Applicant: TVP Developments Limited Company (Ltd.), Kowloon (HK)

(72) Inventor: Kishore Kunal Samtani, Kowloon (HK)

(73) Assignee: TVP Developments Limited Company (Ltd.), Kowloon (HK)

( * ) Notice: Subject to any disclaimer, the term of this patent is extended or adjusted under 35 U.S.C. 154(b) by 0 days.

(21) Appl. No.: 15/433,134

(22) Filed: Feb. 15, 2017

(65) Prior Publication Data

US 2018/0228327 A1 Aug. 16, 2018

(51) Int. Cl.

| | |
|---|---|
| ***A47L 5/30*** | (2006.01) |
| ***A47L 11/40*** | (2006.01) |
| ***A47L 9/28*** | (2006.01) |
| ***A47L 9/32*** | (2006.01) |
| ***A47L 9/00*** | (2006.01) |

(52) U.S. Cl.

CPC ..... *A47L 5/30* (2013.01); *A47L 9/009* (2013.01); *A47L 9/2857* (2013.01); *A47L 9/2884* (2013.01); *A47L 9/325* (2013.01)

(58) Field of Classification Search

CPC ..... A47L 5/30; A47L 9/2842; A47L 9/2847; A47L 9/2852; A47L 9/325; A47L 11/4005; A47L 11/4025

See application file for complete search history.

(56) References Cited

U.S. PATENT DOCUMENTS

| | | | | |
|---|---|---|---|---|
| 2,564,339 | A | 8/1951 | Nerheim | |
| 3,040,362 | A | 6/1962 | Krammes | |
| 3,758,914 | A | 9/1973 | Nupp et al. | |
| 4,209,875 | A | 7/1980 | Pugh et al. | |
| 4,380,845 | A | 4/1983 | Miller et al. | |
| 4,467,493 | A | 8/1984 | Buchtel | |
| 5,500,979 | A * | 3/1996 | Worwag | A47L 5/32 15/335 |
| 6,442,792 | B1 * | 9/2002 | Sudou | A47L 5/22 15/339 |
| 6,817,059 | B2 * | 11/2004 | Tsuchiya | A47L 5/28 15/345 |
| 7,496,984 | B2 * | 3/2009 | Pang | A47L 9/242 15/144.1 |
| 8,813,297 | B2 * | 8/2014 | Rosenzweig | A47L 5/28 15/144.1 |
| 2006/0196004 | A1 * | 9/2006 | Conrad | A47L 5/30 15/352 |
| 2009/0019663 | A1 * | 1/2009 | Rowntree | A47L 5/24 15/347 |
| 2011/0138570 | A1 * | 6/2011 | Hsu | A47L 7/02 15/383 |

FOREIGN PATENT DOCUMENTS

WO WO 2008/088278 A2 7/2008

* cited by examiner

*Primary Examiner* — Dung Van Nguyen

(74) *Attorney, Agent, or Firm* — Baker & Hostetler LLP

(57) ABSTRACT

A portable lightweight cordless vacuum cleaner that easily maneuverable includes a dirt bin that may be easily emptied and a pivoting handle apparatus.

16 Claims, 4 Drawing Sheets

MANEUVERABLE CORDLESS STICK VACUUM

TECHNICAL FIELD

This disclosure relates to a portable, safe, easy and effective device for cleaning. More specifically, the present disclosure relates to a "stick"-type vacuum that is cordless, includes an articulable handle, and is mounted on casters and has a sliding surface making the vacuum very easy to use and maneuver.

BACKGROUND

Conventional vacuum cleaners are well known. They are known to include an upper portion having a handle, by which an operator of the vacuum cleaner may grasp and maneuver the cleaner, and a lower cleaning nozzle portion which travels across a floor, carpet, or other surface being cleaned. The upper portion is often formed as a rigid plastic housing which encloses a dirt and dust collecting filter bag, although the upper portion may simply be an elongated handle with the filter bag, and an external cloth bag, being connected thereto. The cleaning nozzle may be hingedly connected to the upper portion such that the upper portion is pivotable between a generally vertical upright storage position and an inclined operative position. The underside of the nozzle may include a suction opening formed therein which is in fluid communication with the filter bag.

Stick vacuum cleaners are also well-known. Specifically, small portable lightweight vacuum cleaners adapted to be hand carried have recently been developed. These types of vacuum cleaners are generally cordless, battery powered electric driven units which include a removable "bin" section to permit removal of the dirt collected therein. Illustrative of these types of vacuum cleaners are Pugh et al, U.S. Pat. No. 4,209,875 and Miller et al U.S. Pat. No. 4,380,845.

Additionally, Nupp et al, U.S. Pat. No. 3,758,914 illustrates a vacuum cleaner that is convertible between an upright vacuum cleaner and a portable hand carried vacuum cleaner. The Nupp et al patent also includes a removable dirt box and a handle which is rotatable between an extended position and a retracted position overlying the dirt box. A number of different forms of vacuum cleaners have been developed wherein dirt boxes or other components of the vacuum cleaner are removable from the body of the unit. Illustrative of such vacuum cleaner structures are those shown in Nerheim, U.S. Pat. No. 2,564,339; Krammes, U.S. Pat. No. 3,040,362; and Buchtel, U.S. Pat. No. 4,467,493.

Similarly to above, International Patent Publication WO 2008/088278 discloses a hand-held and stick vacuum cleaner, which can selectively carry out a handy type cleaning or a stick type cleaning. The disclosed hand-held and stick vacuum cleaner is configured, so that a hand-held cleaner unit is detachably mounted in a front part of a stick assembly. Accordingly, the hand-held and stick vacuum cleaner can carry out the cleaning operation in a state where the hand-held cleaner unit is mounted in the front part of the stick assembly (hereinafter, referred as "the stick type cleaning"), or in a state where the hand-held cleaner unit is not mounted in, but separated from the front part of the stick assembly (hereinafter, referred as "the hand-held type cleaning").

Conversely, the stick vacuum cleaner disclosed in the international patent laid-open WO 2008/088278, discloses yet another convertible-type stick vacuum cleaner.

Regardless, it is known for vacuums such as this to include a motor and fan assembly that is enclosed either within the nozzle portion or the upper portion of the cleaner. The vacuum source generates the suction required to pull dirt from the carpet or floor being vacuumed through the suction opening and into the removable bin. A rotating brush assembly is typically provided in proximity to the suction opening to loosen dirt and debris from the carpet being vacuumed.

While prior art vacuum cleaners are generally very effective and are in widespread use, there has been found a need to provide a more effective and easy to way to clean. Specifically, although attempts have been made to provide stick vacuum cleaners for suctioning dirt from the corners and edges of a room, these prior edge and corner cleaning upright vacuum cleaners have not been entirely effective or easy to use. Furthermore, prior art stick vacuum cleaners have failed to bring together all of the benefits of extreme maneuverability, cordless convenience, low profile design and including a pivotable handle.

Accordingly, it would be desirable to provide an improved stick vacuum cleaner which would overcome the foregoing difficulties and others while providing better and more advantageous overall results.

SUMMARY

According to the present disclosure, a new and improved stick vacuum cleaner is provided. In accordance with a first aspect of the present disclosure, a stick vacuum cleaner is provided that is powered by a rechargeable battery. In another aspect of the disclosure an, upright stick vacuum is disclosed having a hinged handle. In another aspect of the disclosure, an upright stick vacuum is disclosed that has superior maneuverability achieved, in part, through the use of casters and a sliding base function. In another aspect of the disclosure, an improved stick vacuum cleaner is provided incorporating all of these features.

Still other benefits and advantages of the invention will become apparent to those skilled in the art upon reading and understanding the following detailed description.

BRIEF DESCRIPTION OF THE DRAWINGS

The invention may take form in certain components and structures preferred embodiments of which will be illustrated in the accompanying drawings wherein.

DETAILED DESCRIPTION

Figure 1:
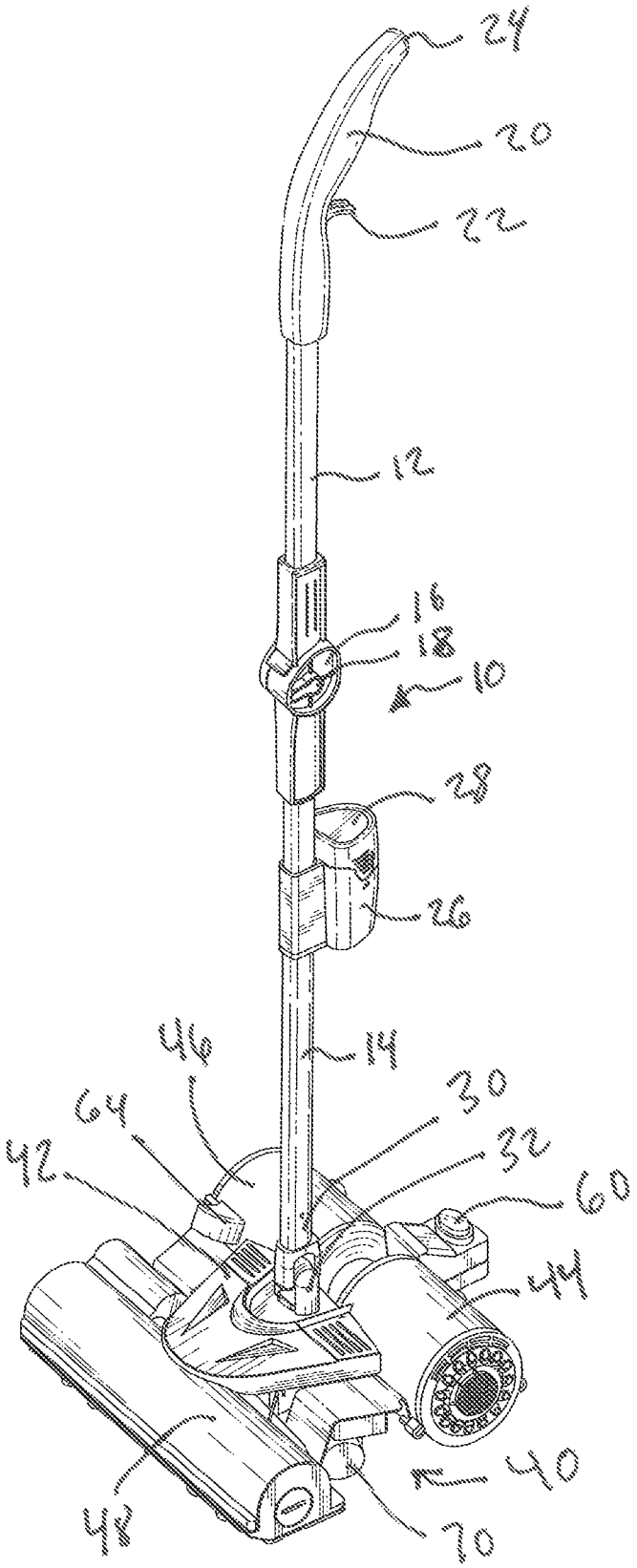
FIG. 1 is a perspective view of an improved vacuum cleaner in accordance with a first embodiment of the present invention.
Figure 2:
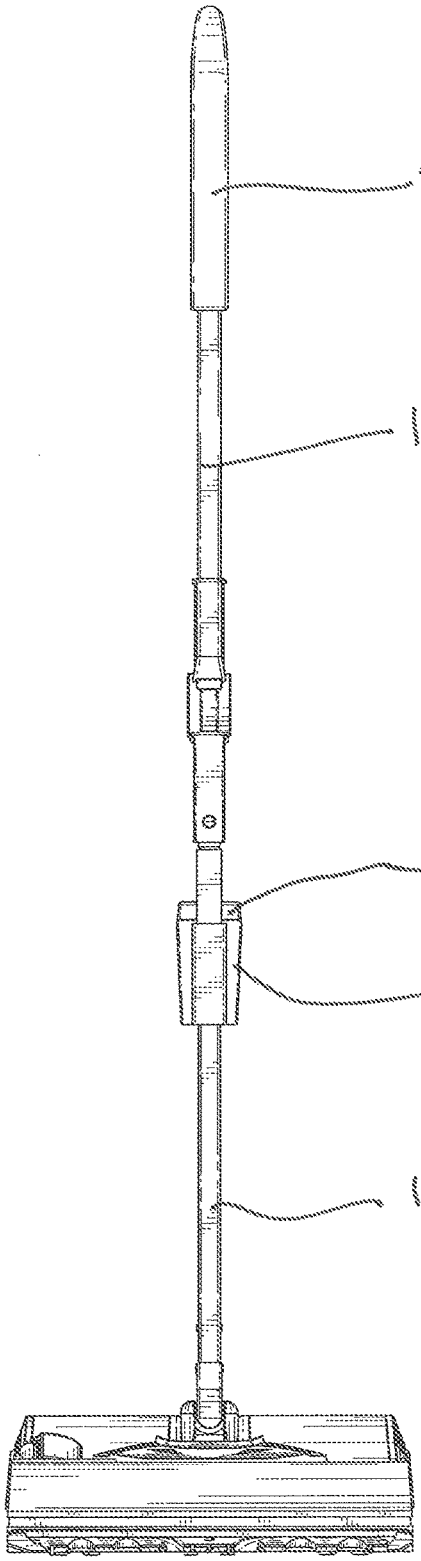
FIG. 2 is a front view thereof.
Figure 3:
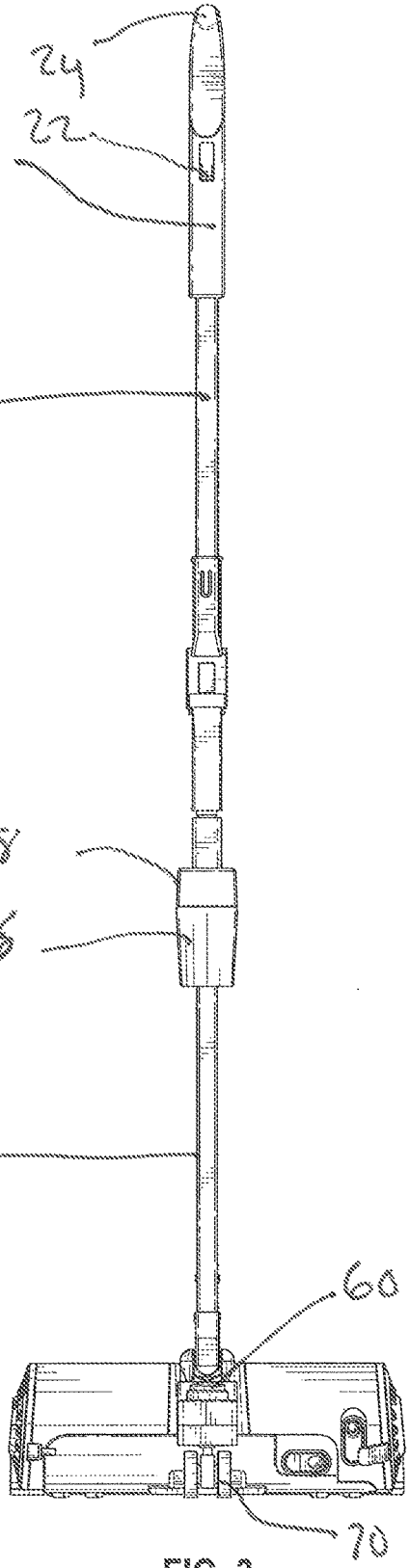
FIG. 3 is a back view thereof.
Figures 4, 5:
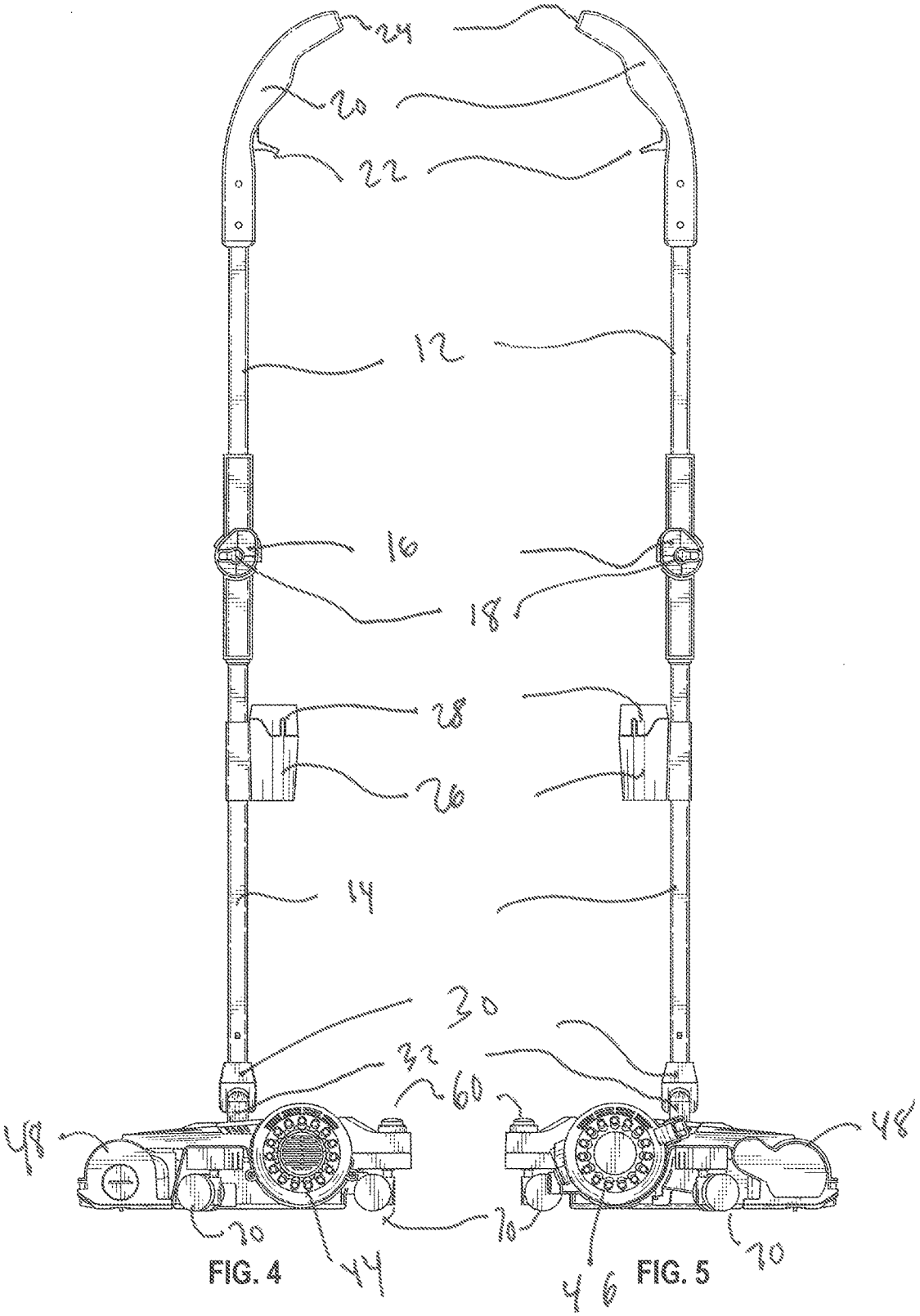
FIG. 4 is a left side elevation view thereof.
FIG. 5 is a right side elevation view thereof.

Referring now to the drawings, wherein it is reminded that the images of the presented embodiment are provided solely for purposes of illustrating aspects of the disclosure and not for purposes of limiting the same, FIG. 1 shows a stick vacuum cleaner 10 in accordance with a first embodiment of the present disclosure. The vacuum cleaner 10 includes an upper handle 12 and a lower handle 14 joined by a joint 16 in the middle thereof. The joint 16 may be a repositionable elbow joint, or the like, and may include a lock mechanism 18 and the upper handle 12 may include a grip section 20 on an upper portion thereof. In accordance with embodiments of the disclosure, the lock mechanism 18 may be operably connected to a trigger release 22 for releasing the lock mechanism 18 on the joint 16. In accordance with embodiments of the disclosure, the grip section may be rubberized or otherwise covered for the users comfort and may include a rubberized tip 24 to prevent the vacuum 10 from slipping when propped up against a wall. In accordance with aspects of the disclosure, the upper handle 12 and lower handle 14 portions may be formed from tubular steel or aluminum and may include fittings made of plastic.

In accordance with other aspects of the disclosure, the vacuum cleaner 10 includes may include a battery pack 26 positioned on the lower handle 14 having a removable cover 28 for storing a battery (not shown), such as a rechargeable lithium ion battery, therein. The battery pack 26 may be electrically connected to a motor for the vacuum cleaner as known in the art. The bottom section 30 of the lower handle 14 may be attached to a swivel joint 32, preferably a 360 degree swivel joint.

In accordance with aspects of the disclosure, and as shown in FIGS. 2-7, the vacuum cleaner 10 may include a base 40 comprised of a handle mount portion 42, motor/fan housing 44, a dirt bin 46, and a brush housing 48. As would be understood by one of ordinary skill in the art, the motor/fan housing 44 includes an otherwise standard motor/fan assembly, the motor (not shown) having a belt (not shown) attached thereto for driving a rotating brush 50 as is known in the art and the fan being connected to the brush housing 48 by a duct 52 to provide suction for the vacuum cleaner 10 when in use. The suction provided by fan (not shown) allows the vacuum cleaner 10 to suck dirt and dust from the surface being cleaned into the dirt bin 46.

Figure 6:
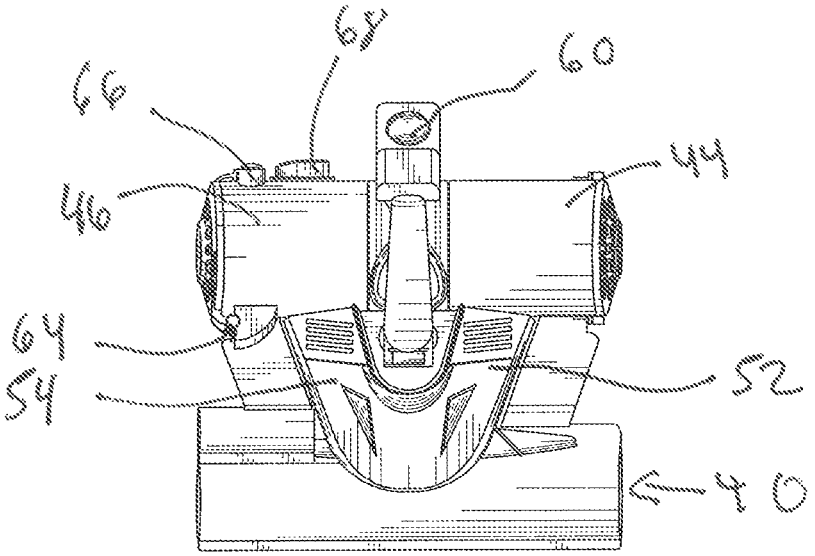
FIG. 6 is a top plan view thereof.
Figure 7:
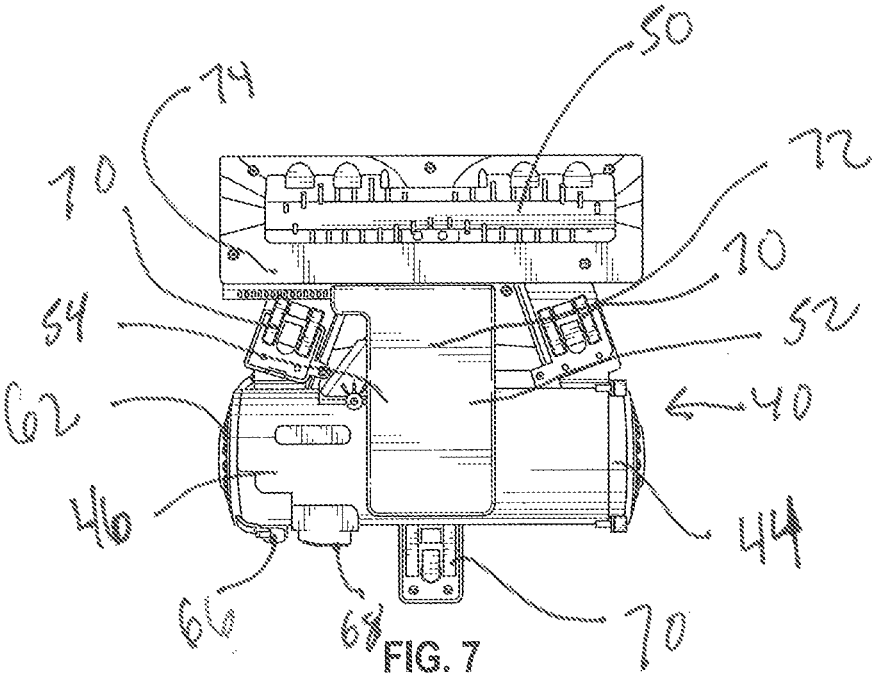
FIG. 7 is a bottom plan view thereof.

As seen best in FIGS. 6 and 7, the base 40 may include a foot button 60 electrically connected to the motor for easy on/off control of the motor. The dirt bin 46 may be equipped with a door 62 connected to the bin 46 by a hinge 64 for easy/quick emptying. A quick lock 66 may be provided for unlocking the door 62 allowing the door 62 to swing open on the hinge 64 thereby allowing the contents of the dirt bin 46 to be easily emptied. For more thorough cleaning, the dirt bin 46 may be slidingly attached to the base 40 and the dirt bin 46 it may be released through manipulation of the lock 68 by the user as is known in the art.

As best seen in FIGS. 6 and 7, the vacuum 10 may be equipped with at least one, two or three swivel casters 70 to allow for easy maneuverability of the vacuum 10 when in use. The underside of the base 40 may include slider surfaces 72, 74 to further increase the maneuverability of the vacuum. In embodiments consistent with the disclosure, the slider surfaces 72, 74 may be comprised of low-friction components such as low friction plastics and/or Teflon® or Teflon®-like products.

It will be appreciated that the foregoing description provides examples of the disclosed apparatus and method. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain functions is intended to indicate a lack of preference for those functions, but not to exclude such from the scope of the disclosure entirely unless otherwise indicated. All methods described herein can be performed in any suitable order unless otherwise indicated herein or otherwise clearly contradicted by context.

The invention claimed is:

1. A vacuum cleaner comprising:

an upper handle having a grip thereon connected to a lower handle by a joint;

a base attached to a lower portion of the lower handle by a swivel joint, the base including a dirt bin and a motor/fan assembly housing a motor/fan assembly wherein the motor drives a rotating brush and the fan creates a suction;

the base including at least two casters mounted to a lower portion thereof and including at least one slider surface mounted on a bottom thereof;

wherein said dirt bin is removably mounted in the base and is cylindrical in shape and includes a door hingedly attached thereto.

2. The vacuum cleaner of claim 1 further comprising a battery pack mounted on either the upper or lower handle.

3. The vacuum cleaner of claim 1 wherein said grip includes a rubberized tip.

4. The vacuum cleaner of claim 1 wherein said motor/fan assembly housing is cylindrical in shape.

5. The vacuum cleaner of claim 1 wherein said swivel joint is a 360 degree swivel joint.

6. The vacuum cleaner of claim 1 wherein said handle includes a rubberized tip on an end thereof.

7. The vacuum cleaner of claim 1 wherein the joint is an elbow joint.

8. The vacuum cleaner of claim 7 wherein the joint includes a trigger release mounted on the handle grip.

9. A vacuum cleaner comprising:

an upper handle having a grip thereon connected to a lower handle by a joint;

a base attached to a lower portion of the lower handle by a swivel joint, the base including a cylindrical dirt bin mounted coaxially with a cylindrical motor/fan assembly housing a motor/fan assembly wherein the motor drives a rotating brush and the fan creates a suction;

the base including at least two casters mounted to a lower portion thereof;

wherein said dirt bin includes a door hingedly attached thereto.

10. The vacuum cleaner of claim 9 further comprising a battery pack mounted on either the upper or lower handle.

11. The vacuum cleaner of claim 9 wherein said grip includes a rubberized tip.

12. The vacuum cleaner of claim 9 wherein said swivel joint is a 360 degree swivel joint.

13. The vacuum cleaner of claim 9 wherein said handle includes a rubberized tip on an end thereof.

14. The vacuum cleaner of claim 9 wherein the joint is an elbow joint.

15. The vacuum cleaner of claim 9 wherein the joint includes a trigger release mounted on the handle grip.

16. A vacuum cleaner comprising:

an upper handle having a grip thereon connected to a lower handle by a joint, the grip having a rubberized tip on and thereof and a joint trigger release attached thereto;

a base attached to a lower portion of the lower handle by a swivel joint, the base including a cylindrical dirt bin mounted coaxially with a cylindrical motor/fan assembly housing a motor/fan assembly wherein the motor drives a rotating brush and the fan creates a suction, the dirt bin including a door hingedly attached thereto;

a battery pack mounted on the lower handle;

the base including at least three casters mounted to a lower portion thereof and including at least one slider surface mounted on a bottom thereof.

* * * * *